US005450630A

United States Patent [19]

Hale

[11] Patent Number: 5,450,630

[45] Date of Patent: Sep. 19, 1995

[54] SOCK AND METHOD OF MAKING SAME

[75] Inventor: Don W. Hale, Afton, Wyo.

[73] Assignee: Wyoming Woolens, Jackson Hole, Wyo.

[21] Appl. No.: 165,947

[22] Filed: Dec. 10, 1993

[51] Int. Cl.[6] ..... A41B 11/00

[52] U.S. Cl. ..... 2/239; 2/409

[58] Field of Search ..... 2/239, 409; 66/178 R, 66/189, 191, 194; 36/1, 10, 8.3, 9 R

[56] References Cited

U.S. PATENT DOCUMENTS

| | | | |
|---|---|---|---|
| 4,809,447 | 3/1989 | Pacanowsky et al. . | |
| 4,845,862 | 7/1989 | Phillips, Jr. et al. . | |
| 4,852,272 | 8/1989 | Chilewich et al. . | |
| 4,907,350 | 3/1990 | Chilewich et al. . | |
| 5,020,164 | 6/1991 | Edwards | 2/239 |

FOREIGN PATENT DOCUMENTS

| | | | |
|---|---|---|---|
| 528805 | 6/1955 | Italy | 2/239 |

OTHER PUBLICATIONS

Federal Standard—No. 751 Stitches, Seams and Stitchings, Aug. 14, 1959—Stitches—Type 601-607.

*Primary Examiner*—C. D. Crowder
*Assistant Examiner*—Gloria Hale
*Attorney, Agent, or Firm*—Welsh & Katz, Ltd.

[57] ABSTRACT

A sock made from a spun polyester fleece material and having flatlock seams is lightweight and quick-drying and provides improved warmth, comfort and a contour fit without causing blisters or the like. In one embodiment, the sock is made from a single-piece generally rectangular blank or pattern of fleece material and has peripheral marginal edges selectively secured in overlapping relation by a flatlock seam. In an alternative embodiment, the sock may be made from discrete blanks or patterns having marginal edges secured by flatlock seams to define a foot receiving portion and a leg encompassing portion.

22 Claims, 1 Drawing Sheet

SOCK AND METHOD OF MAKING SAME

BACKGROUND OF THE INVENTION

The present invention relates generally to socks, and more particularly to a novel sock construction and method of manufacture which provides improved warmth and comfort over prior sock constructions.

With the increasing interest in outdoor camping and sporting activities, such as hiking, rafting, kayaking and cross country skiing and the like where both cold and wet conditions are commonly encountered, maintaining one's feet warm and comfortable is of major importance. With almost all activities of this type, the participant's feet may become wet or damp and cold by exposure to external sources of cold water, or by perspiration that is captured in the socks. In all cases, it is important that the socks be capable of quick drying while also providing desired warmth and comfort.

Socks presently available which are particularly intended to be worn in environments where the wearer's feet may be exposed to adverse conditions, such as in the aforedescribed outdoor activities, are generally made from a knit material, such as disclosed in U.S. Pat. Nos. 1,418,617, 1,752,587, 3,122,906 and 4,422,307. It is also proposed to make socks from a composite material, such as disclosed in U.S. Pat. No. 5,020,164, or from a material knit from a body yarn in successive courses with hydrophobic and hydrophilic yarns knit in plated relation with the body yarn, such as disclosed in U.S. Pat. No. 5,095,548.

In all known prior sock constructions having one or more sewn seams which interconnect one or more knitted blanks or panels to create the finished sock, the seam creates a raised ridge which can cause blisters where it engages the foot. In addition to the discomfort of such socks, the blister may break and become infected, particularly where the socks are warn under conditions where exposure to infection is not easily prevented. Accordingly, a lightweight sock made of a material which provides desired warmth even when damp, is capable of relatively quick drying, affords a comfortable contoured fit, and eliminates conventional raised seam stitching would provide significant advantages over known sock constructions, particularly where intended for use in the aforedescribed activities.

SUMMARY OF THE INVENTION

A general object of the present invention is to provide a novel sock construction and method of manufacture which results in a lightweight, breathable and quick drying sock having improved warmth and comfort over prior socks.

Another object of the present invention is to provide a novel sock construction wherein the sock is made from a spun fleece material and utilizes flatlock seams so as to eliminate conventional raised sewn seams and provide significantly improved comfort and warmth.

A more particular object of the present invention is to provide a novel sock construction and method of manufacture wherein the sock is made from one or more blanks or patterns of spun fleece material such that each blank has a predetermined outer peripheral edge, and wherein the outer peripheral edges of the one or more blanks are interconnected by flatlock seams to form foot receiving and leg encompassing portions of the sock.

A feature of one embodiment of a sock and its method of manufacture in accordance with the present invention lies in providing a single-piece substantially rectangular blank or pattern of spun fleece material having substantially parallel longitudinal marginal edges in which first and second pairs of laterally opposed generally V-shaped dart cuts are formed, folding the blank generally transversely so that the longitudinal marginal edges and dart cut marginal edges are in mutually juxtaposed relation, and securing the juxtaposed marginal edges together by flatlock seams so as to form foot receiving and leg encompassing sock portions without utilizing conventional raised stitched seams in any portion of the sock which engages the wearer's foot.

In accordance with an alternative embodiment of the invention, the sock may be made of a plurality of blanks or patterns of spun fleece material having outer marginal edges which are selectively interconnected through flatlock seams so as to provide an improved lightweight quick-drying sock having improved warmth and comfort without raised stitched seams.

Another feature of the various sock constructions in accordance with the present invention lies in providing a knitted expansion control band about the foot receiving opening of the fleece material sock body to maintain the sock in relatively fixed relation on the wearer's foot and leg.

Further objects, features and advantages of the present invention will become apparent from the following detailed description when taken in conjunction with the accompanying drawings wherein like reference numerals designate like elements throughout the several views.

DETAILED DESCRIPTION

Figure 1:
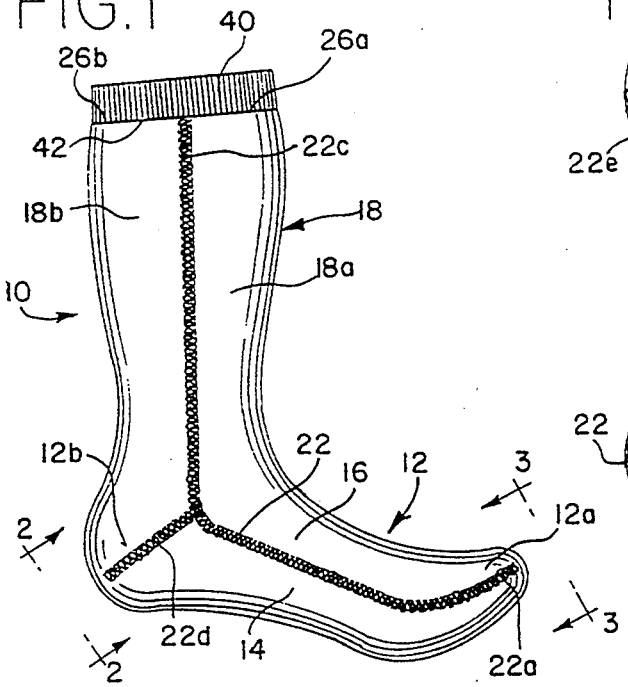
FIG. 1 is a side elevational view of a sock constructed in accordance with the present invention.

Referring now to the drawing, and in particular to FIGS. 1–4, a sock constructed in accordance with one embodiment of the present invention is indicated generally at 10. The sock 10 is adapted to be worn on one's foot and includes a foot receiving portion 12 having a toe end pocket **12*a* and a heel end pocket 12*b*. The foot receiving portion 12 of the sock is bounded along its lower surface by a sole panel 14 which underlies the wearer's foot, and is bounded along its upper surface by an upper panel 16 which generally overlies and engages the upper surface of the wearer's foot. A tubular portion 18 of the sock extends generally upwardly from the foot receiving portion 12 and is adapted to encompass the lower portion of the wearer's leg at or above the ankle in a conventional manner. The leg encompassing portion 18** may be of any desired length, such as a length sufficient to extend upwardly over the wearer's calf if desired.

In accordance with one feature of the sock 10, the sock is made from a spun fleece material with substantially all seams, and particularly the seams formed at the foot receiving portion 12, being flatlock stitched seams, as contrasted with conventional stitched seams which establish raised ridge-like seams. The fleece material preferably comprises 100% spun polyester fabric having small air pockets throughout the material which trap air and create an insulating barrier. The fleece material is relatively light in weight and made highly breathable, even when damp. The fleece material is formed with a relatively upright velour pile that provides a soft stretchable fit and contours well to the wearer's foot. The fleece material is selected to exhibit high wicking characteristics so as to dry quickly while being worn or when removed from the foot. The fleece material preferably has a moisture vapor transmission factor of approximately 900 grams per square meter over a 24 hour time period, and has an air permeability factor (under ASTM D737-15) of 247 cubic feet of air per square foot of fabric area per minute (equivalent to 125 $cm^3/cm^2/sec.$). The fleece material preferably has an diathermic insulation factor (under ASTM D1518) which provides a Clo rating of approximately 1.2 (equivalent to a Tog rating of approximately 1.66). The material also preferably has a weight or density in the range of approximately 7.8 $oz./yd^2$–8.1 $oz./yd^2$. A fleece material having the aforedescribed characteristics may be obtained from Malden Mills Industries, Inc. under its Polartec TM Series 200 brand.

Figure 5:
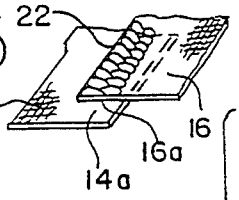
FIG. 5 is a fragmentary perspective view illustrating a flatlock overlapping seam of the type employed in the present invention.

As aforementioned, preferably all seams in the sock 10, and particularly longitudinal seams which extend along laterally opposite sides of the socks, one of which is indicated at 22 in FIG. 1, are of the flatlock seam type so as not to create any raised seams in the portions of the sock which are disposed between the wearer's foot, ankle and leg and any outer footwear such as a shoe or boot or the like. FIG. 5 illustrates a flatlock seam of the flatlock overlapping type preferably employed in the present invention, such as the seam 22. As shown, a marginal edge 16*a* of the panel 16 overlaps a marginal edge 14a of the panel 14 in juxtaposed relation. A four-needle, six thread interlock seam is then sewn along the overlapping marginal edge portions to create a flatlock overlapping seam. Alternatively, the two juxtaposed panel edges 16*a* and 14*a* may be disposed in edge-to-edge butting relation and the interlock seam formed so as to extend through each marginal edge and across the butt joint. Machinery for forming such flatlock seams is commercially available.

Figure 2:
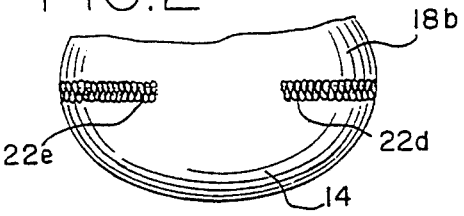
FIG. 2 is a fragmentary view taken substantially along line 2—2 of FIG. 1 illustrating the heel pocket of the sock.
Figure 3:
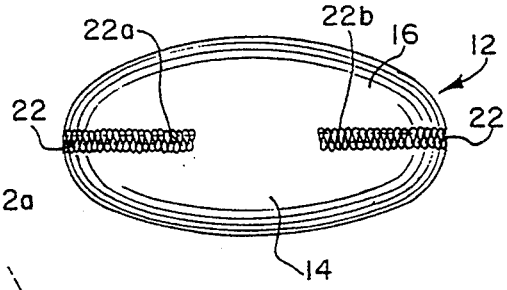
FIG. 3 is a fragmentary view taken substantially along line 3—3 of FIG. 1 illustrating the toe pocket of the sock.
Figure 4:
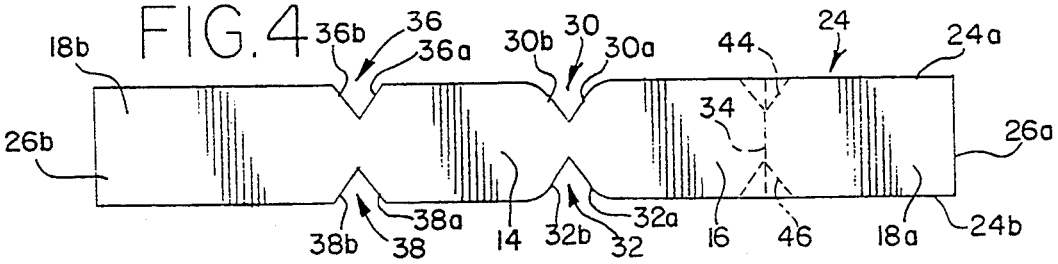
FIG. 4 is a plan view of a blank or pattern from which the sock of FIG. 1 is constructed.

The sock 10 illustrated in FIGS. 1–3 is made from a single-piece rectangular blank or pattern, indicated generally at 24 in FIG. 4, of the fleece material. The blank or pattern 24 has substantially parallel longitudinal marginal edges 24*a* and 24*b* and transverse marginal end edges 26*a* and 26*b*. A first pair of laterally opposed generally V-shaped dart cuts 30 and 32 are formed in the longitudinal marginal edges 24*a* and 24*b* of the blank, such as indicated by V-shaped marginal edges 30*a,b* and 32*a,b* defining the dart cuts 30 and 32, respectively. The dart cuts 30 and 32 are spaced a predetermined distance from the transverse end edge 26*a* of the blank 24 so as to establish the panel 16 which will form the upper panel of the foot receiving sock portion 12, and a contiguous panel 18*a* which extends generally from a transverse fold line, indicated in phantom at 34, to the end edge 26*a* and will form a forward panel of the leg encompassing portion 18 of the sock. The dart cuts 30 and 32 are formed so that their respective marginal edges 30*a,b* and 32*a,b* intersect the corresponding longitudinal marginal edges 24*a* and 24*b* of the blank or pattern 24 through radially curved convex corners which form the generally rounded toe pocket end 12*a* of the sock.

A second pair of laterally opposed generally V-shaped dart cuts 36 and 38 are formed in the longitudinal marginal edges 24*a,b* of the blank spaced longitudinally from the dart cuts 30 and 32. The dart cuts 36 and 38 are similarly defined by generally V-shaped marginal edges 36*a,b* and 38*a,b* respectively. The dart cuts 36 and 38 are spaced longitudinally from the dart cuts 30 and 32 a predetermined distance so as to establish the desired length sole panel 14 and establish the heel end pocket 12*b* of the assembled sock. The longitudinal length of the blank 24 is selected so that the transverse end edge 26*b* is spaced from the dart cuts 36 and 38 a distance sufficient to place the end edge 26*b* in juxtaposed relation to the opposite transverse end edge 26*a* when the blank is folded transversely about fold lines connecting the vertices of each opposed pair of dart cuts 30,32 and 36,38, thereby establishing the rear panel 18*b* of the leg encompassing portion 18 of the sock. The dart cuts 30, 32, 36 and 38 have an included vertex angle in the range of approximately 60 to 70 degrees, although other dart cut vertex angles could also be used.

In making the preferred embodiment of sock 10 from the blank or pattern 24, the blank is folded about transverse fold lines interconnecting the vertices of the opposed dart cuts such that the longitudinal marginal edges of the panel 16 overlap or underlap the corresponding longitudinal marginal edges of the panel 14 in juxtaposed relation, as illustrated in FIG. 5, and the marginal edges of each dart cut, such as edges 30*a*, 30*b* of dart cut 30, are disposed in similar juxtaposed overlapping or underlapping relation to each other. The juxtaposed marginal edges are then secured together by flatlock sewn seams starting from the forward toe end of the sock, as indicated at 22*a* and 22*b* in FIG. 3, and extending along the juxtaposed panels 14 and 16. At this point, the panels 18*a* and 18*b* are positioned in juxtaposed relation such that their corresponding longitudinal marginal edges are disposed in similar overlapping relation as the marginal edges of the panels 14 and 16, and the flatlock seams on opposite sides of the sock are continued along the lengths of the opposed panels 18*a* and 18*b* to their upper ends, as indicated at 22*c* in FIG. 1. The overlapping marginal edges of each dart cut 36 and 38, such as 36*a,b*, are then secured together by similar flatlock seams, as indicated at 22*d* and 22*e* in FIG. 2, to form the heel pocket end 12*b*. Alternatively, it may be desirable to secure the marginal edges of each dart cut 36 and 38 by flatlock seams prior to initiating the full side flatlock seams such as 22.

If desired, a third pair of laterally opposed generally V-shaped dart cuts may be formed in the longitudinal marginal edges 24*a* and 24*b* of the blank or pattern 24, such as represented by dash lines 44 and 46 in FIG. 4, so that the vertices of the third pair of dart cuts lie on the fold line 34. The dart cuts 44 and 46 would be positioned and configured so that folding of the panel 18*a* about the fold line 34 to place panel 18*a* in juxtaposition to panel 18*b* would effect overlapping of the marginal edges of the respective dart cuts 44 and 46 which would then be secured together by flatlock seams generally coextensive with the heel pocket seams 22*d* and 22*e*.

After the blank or pattern 24 has been formed into the aforedescribed partially completed sock an endless annular elastic fabric band or collar 40 of known construction is preferably secured to the juxtaposed end edges 26*a,b* of the blank 24. The band or collar 40 may be secured to the end edges 26*a,b* by a conventional stitched seam, such as indicated at 42, and is capable of hugging the wearer's leg above the ankle region to prevent the leg encompassing portion 18 of the sock from falling down when worn.

Figure 7:
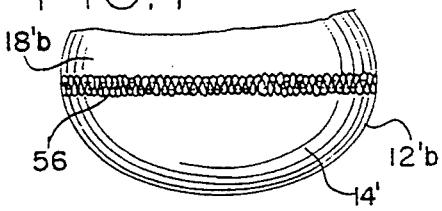
FIG. 7 is a fragmentary view similar to FIG. 2 but showing the heel pocket of a sock constructed from the three blanks or patterns illustrated in FIG. 6.
Figure 8:
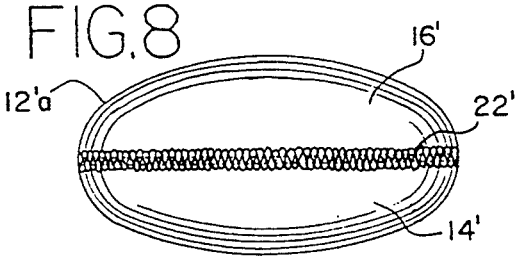
FIG. 8 is a fragmentary view similar to FIG. 3 but illustrating the toe pocket of a sock constructed from the blanks or patterns of FIG. 6.
Figure 6:
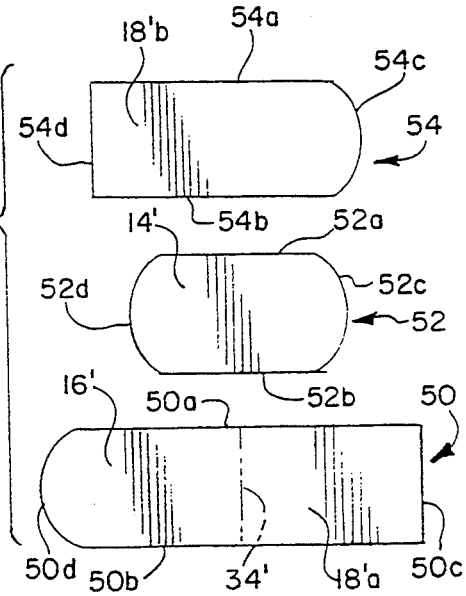
FIG. 6 is a plan view illustrating three discrete blanks or patterns for making an alternative embodiment of a sock in accordance with the present invention.

FIGS. 6–8 illustrate an alternative embodiment of a sock construction in accordance with the present invention wherein a sock similar to sock 10 results but is made from three discrete blanks or patterns indicated at 50, 52 and 54 in FIG. 6. The blanks or patterns 50, 52 and 54 are each made from a spun polyester fleece material, similar to the blank 24, and each is generally rectangular in plan configuration. The blank or pattern 50 has longitudinal marginal edges 50*a* and 50*b*, a transverse end edge 50*c* and a convexly curved opposite end edge 50*d*. The blank 50 has a longitudinal length substantially equal to the combined longitudinal lengths of the panels 16 and 18*a* illustrated in FIG. 4, and is divided by a phantom fold line 34' to define similar panel portions 16' and 18'*a*.

The blank or pattern 52 has longitudinal marginal edges 52*a,b* and convexly curved opposite end edges 52*c* and 52*d* to define a panel 14' having a plan configuration substantially similar to the panel 14 defined by the blank or pattern 24. The blank or pattern 54 has longitudinal marginal edges 54*a* and 54*b*, a convexly curved end edge 54*c* and a transverse opposite end edge 54*d* so as to define a panel 18'*b* having a configuration substantially similar to panel portion 18*b* of blank 24.

In forming a sock form the blanks or patterns 50, 52 and 54, the longitudinal marginal edges of panel 16' and the convexly curved edge 50*d* are placed on the panel 14' so that the curved marginal edges are in juxtaposed overlapping or underlapping relation. Such juxtaposed edges are then secured together so as to create a flatlock overlapping seam which extends along the opposite longitudinal marginal edges and along the overlapping convexly curved end edges around the full toe pocket end 12'*a*, as indicated by flatlock seam 22' in FIG. 8.

Preferably, prior to flatlock seam connection of the overlapping marginal edges of the panels 14' and 16', the convex marginal edge 52*d* of panel 14' is secured to the convex marginal edge 54*c* of panel 18'*b* to form a flatlock overlapping seam 56 (FIG. 7) which will define the heel pocket 12'*b* of the sock. By first flatlock seaming the convex edges 52*d* and 54*c* together, the panels 16' and 18' a can be positioned in overlying relation to the panels 14' and 18'*b*, respectively, to facilitate overlapping of the corresponding marginal edges and securing them together by flatlock stitching to create a flatlock overlapping seam similar to that shown in FIG. 5. In this manner, the seam can extend continuously along one side of the sock, starting at the juxtaposed end edges 50*c* and 54*c*, continue around the overlapping convex edges 50*d* and 52*c* to form the toe pocket, and along the opposite side of the sock back to the transverse end edges 50*c* and 50*d*. An annular elastic band or collar can then be secured to the juxtaposed end edges 50*c* and 54*d* of the panels 18'*a* and 18'*b* in similar fashion to the band or collar 40 of sock 10.

Thus, in accordance with the present invention, novel sock constructions and methods of making them are provided wherein the socks are made from a spun polyester fleece material and employ flatlock seams. The fleece material eliminates blistering of the feet as frequently experienced with conventional warp and weft-knitted fabric material. The flatlock seams, whether of the preferred flatlock overlapping type or of a flatlock butt joint type, eliminate raised sewn seams as in prior sock constructions, thereby further reducing the chance for blistering. The fleece material, through its minute air pockets and significant wicking action, provides increased warmth even when the socks are damp or wet, and reduces drying time. The fleece material is lightweight and stretchable and thereby enables a comfortable contour fit which cannot be achieved with conventional knitted sock fabrics that have very little stretchability, if any.

While preferred embodiments of the present invention have been illustrated and described, it will be understood to those skilled in the art that changes and modifications may be made therein without departing from the invention in its broader aspects. Various features of the invention are defined in the following claims.

What is claimed is:

1. A sock made from a single-piece generally rectangular blank of fleece material having substantially parallel longitudinal marginal edges, and first and second pairs of laterally opposed generally V-shaped dart cuts formed in said longitudinal marginal edges so as to define a sole panel between said pairs of dart cuts, said rectangular blank being formed about transverse fold lines defined between said dart cuts such that the longitudinal marginal edges and marginal edges of said dart cuts are in mutually juxtaposed relation and secured together by flatlock seams to define a foot receiving portion and a leg encompassing portion.

2. A sock as defined in claim 1 wherein said rectangular blank has transverse marginal end edges disposed in juxtaposed relation when said blank is folded about said transverse fold lines, and including an elastic band secured to said juxtaposed end edges and adapted to encircle the leg portion of a wearer.

3. A sock as defined in claim 1 wherein said juxtaposed longitudinal marginal edges and marginal edges of said dart cuts are disposed in overlapping relation.

4. A sock comprising a foot receiving portion and a lower leg encompassing portion, said sock being made from at least one generally rectangular blank of polyester fleece material having marginal edges and having first and second pairs of laterally opposed generally V-shaped dart cuts formed in said longitudinal marginal edges, said blank being formed generally transversely of itself so that the longitudinal marginal edges and marginal edges of the dart cuts are in mutually opposed relation and secured together by at least one flatlock seam so as to form said foot receiving portion and said lower leg encompassing portion.

5. A sock as defined in claim 3 including an elastic band secured to a free marginal edge of the leg encompassing portion.

6. A sock as defined in claim 4 wherein at least one pair of said dart cuts is defined by marginal edges which intersect the corresponding longitudinal marginal edges through curved edges so as to define a convexly curved toe pocket of said foot receiving portion.

7. A method of making a sock having a foot receiving portion and a lower leg encompassing portion, said method comprising the steps of:

forming a single-piece generally rectangular blank from fleece material, said blank having substantially parallel longitudinal marginal edges;

forming a first pair of laterally aligned dart cuts in said longitudinal marginal edges intermediate the length thereof;

forming a second pair of laterally aligned dart cuts in said longitudinal marginal edges intermediate the length thereof spaced from said first pair of dart cuts, forming said blank generally transversely of itself so as to bring each longitudinal marginal edge into mutually opposed relation with itself with marginal edges of each of said dart cuts being in mutually opposed relation, and securing said mutually opposed longitudinal marginal edges and dart marginal edges together by at least one flatlock seam so as to form said foot receiving portion and said leg encompassing portion.

8. The method as defined in claim 7 wherein said blank is formed with substantially transverse end edges which are disposed in juxtaposed relation when said blank is formed to establish said leg encompassing portion, and including the step of securing an annular elastic band to said juxtaposed transverse end edges.

9. The method of claim 7 wherein said first pair of laterally aligned dart cuts are each defined by generally V-shaped marginal edges which intersect their corresponding longitudinal marginal edge through convexly curved corner edges, said first dart cuts defining curved lateral margins of a toe pocket of the sock.

10. The method of claim 9 wherein said second pair of laterally aligned dart cuts are each defined by a generally V-shaped marginal edge, said second pair of dart cuts defining the lateral margins of a heel pocket of the sock.

11. The method of claim 7 wherein the mutually opposed longitudinal marginal edges and mutually opposed dart cut marginal edges are secured together in overlapping relation by flatlock seams.

12. The method of claim 11 wherein said mutually opposed edges of said first pair of dart cuts form lateral marginal edges of a toe pocket, said flatlock seams each extending continuously from the toe pocket to the mutually opposed transverse end edges of the blank.

13. The method of claim 7 wherein said fleece material comprises spun polyester.

14. The method as defined in claim 10 wherein said first and second pairs of dart cuts, each have marginal edges defining an included vertex angle in the range of approximately 60 to 70 degrees.

15. A sock made in accordance with the method of claim 8.

16. A pattern for forming a sock having a foot receiving portion and a leg encompassing portion, said pattern being formed from polyester fleece material and having a generally rectangular plan configuration defining longitudinal marginal edges, first and second pairs of laterally opposed dart cuts formed in said longitudinal marginal edges and defining fold lines between each pair of dart cuts, said pattern being foldable about said fold lines to enable placement of marginal edges of each of said dart cuts in juxtaposed relation to each other and placement of each of said longitudinal marginal edges in juxtaposed relation to itself such that securing of said juxtaposed marginal edges forms a foot receiving portion and a leg encompassing portion.

17. A pattern for forming a sock as defined in claim 16 wherein said dart cuts are generally V-shaped.

18. A pattern for forming a sock as defined in claim 17 wherein at least one pair of said dart cuts have marginal edges which intersect the corresponding longitudinal marginal edges through radially curved edges such that folding of the pattern about a fold line defined between said at least one pair of dart cuts forms a toe pocket having a convex curvature.

19. A pattern for forming a sock as defined in claim 16 wherein said pairs of dart cuts are longitudinally spaced to define a sole panel therebetween.

20. A pattern for forming a sock as defined in claim 19 wherein said pattern has generally transverse end edges spaced from said pairs of dart cuts to define a pair of panels which lie in juxtaposed relation and establish the leg encompassing portion of a sock formed from said pattern.

21. A sock for wearing on a human foot, said sock being made from three blanks or patterns of lightweight fleece material having peripheral marginal edges configured to enable placement of said marginal edges in selective juxtaposed relation, and flatlock seams securing said juxtaposed marginal edges selectively together to define a foot receiving portion and a leg encompassing portion of the sock.

22. A method of making a sock having a foot receiving portion and a lower leg encompassing portion, said method comprising the steps of:

forming three blanks or patterns of fleece material having generally rectangular plan configurations, a first one of said blanks having longitudinal marginal edges, a transverse end edge and a convexly curved opposite end edge; a second one of said blanks having longitudinal marginal edges and convexly curved opposite end edges; and a third one of said blanks having longitudinal marginal edges, a transverse end edge and a convexly curved opposite end edge, said longitudinal marginal edges and convexly curved edges enabling placement in selective juxtaposed relation;

positioning said blanks so that said marginal edges are disposed in said selective juxtaposed relation; and selectively securing said juxtaposed marginal edges together by flatlock seams so as to establish said foot receiving and leg encompassing sock portions.

* * * * *

US005450630C1

(12) REEXAMINATION CERTIFICATE (4298th)

United States Patent

Hale

(10) Number: US 5,450,630 C1

(45) Certificate Issued: Mar. 27, 2001

(54) SOCK AND METHOD OF MAKING SAME

(75) Inventor: Don W. Hale, Afton, WY (US)

(73) Assignee: Wyoming Woolens, Jackson Hole, WY (US)

Reexamination Requests:
No. 90/004,116, Jan. 23, 1996
No. 90/004,507, Jan. 7, 1997

Reexamination Certificate for:

| | |
|---|---|
| Patent No.: | **5,450,630** |
| Issued: | **Sep. 19, 1995** |
| Appl. No.: | **08/165,947** |
| Filed: | **Dec. 10, 1993** |

(51) Int. Cl.[7] ..... A41B 11/00

(52) U.S. Cl. ..... 2/239; 2/409

(58) Field of Search ..... 2/239, 409; 66/178 R, 66/189, 191, 194; 36/1, 10, 8.3, 9 R

(56) References Cited

U.S. PATENT DOCUMENTS 255,753 4/1882 Aiken .

FOREIGN PATENT DOCUMENTS 1509998 1/1968 (FR) .

OTHER PUBLICATIONS

Specialty News, Sep. 1992.
Sporting Goods Business, Oct. 1992.
Battle Creek Enquirer, Nov. 13, 1992.
Wausau Daily Herald, Nov. 16, 1992.
Ski Tech, Nov./Dec. 1992.
Reno Gazette–Journal, Nov. 22, 1992.
Argus Leader, Dec. 6, 1992.
FM (Footwear News) vol. 48, No. 49, Dec. 7, 1992.
Patagonia Spring 1991 Catalog, pp. 30, 33, 38.
Patagonia Fall/Winter 1991 Catalog, pp. 30, 43, 53.
Columbus Dispatch, Dec. 8, 1992.

*Primary Examiner*—Gloria M. Hale

(57) ABSTRACT

A sock made from a spun polyester fleece material and having flatlock seams is lightweight and quick-drying and provides improved warmth, comfort and a contour fit without causing blisters or the like. In one embodiment, the sock is made from a single-piece generally rectangular blank or pattern of fleece material and has peripheral marginal edges selectively secured in overlapping relation by a flatlock seam. In an alternative embodiment, the sock may be made from discrete blanks or patterns having marginal edges secured by flatlock seams to define a foot receiving portion and a leg encompassing portion.

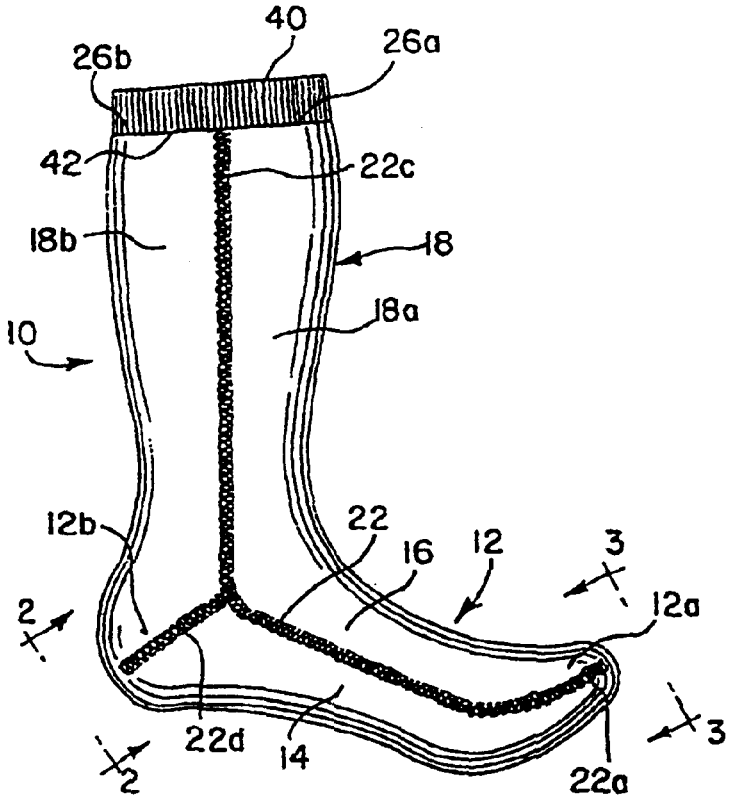

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 16–20 are cancelled.

Claims 1, 4, 7, 15, 21 and 22 are determined to be patentable as amended.

Claims 2, 3, 5, 6 and 8–14, dependent on an amended claim, are determined to be patentable.

1. A sock made from a single-piece generally rectangular blank of *stretchy polyester* fleece material having substantially parallel longitudinal marginal edges, and first and second pairs of laterally opposed generally V-shaped dart cuts formed in said longitudinal marginal edges so as to define a sole panel between said pairs of dart cuts, said rectangular blank being formed about transverse fold lines defined between said dart cuts such that the longitudinal marginal edges and marginal edges of said dart cuts are in mutually juxtaposed relation and secured together by flatlock seams to define a foot receiving portion and a leg encompassing portion.

4. A sock comprising a foot receiving portion and a lower leg encompassing portion, said sock being made from at least one generally rectangular blank of *stretchy* polyester fleece material having marginal edges and having first and second pairs of laterally opposed generally V-shaped dart cuts formed in said longitudinal marginal edges, said blank being formed generally transversely of itself so that the longitudinal marginal edges and marginal edges of the dart cuts are in mutually opposed relation and secured together by at least one flatlock seam so as to form said foot receiving portion and said lower leg encompassing portion.

7. A method of making a sock having a foot receiving portion and a lower leg encompassing portion, said method comprising the steps of:

forming a single-piece generally rectangular blank from *stretchy polyester* fleece material, said blank having substantially parallel longitudinal marginal edges;

forming a first pair of laterally aligned dart cuts in said longitudinal marginal edges intermediate the length thereof;

forming a second pair of laterally aligned dart cuts in said longitudinal marginal edges intermediate the length thereof spaced from said first pair of dart cuts, forming said blank generally transversely of itself so as to bring each longitudinal marginal edge into mutually opposed relation with itself with marginal edges of each of said dart cuts being in mutually opposed relation, and securing said mutually opposed longitudinal marginal edges and dart marginal edges together by at least one flatlock seam so as to form said foot receiving portion and said leg encompassing portion.

15. A sock made in accordance with the method of claim [8] *7*.

21. A sock for wearing on a human foot, said sock being made from three blanks or patterns of lightweight *polyester* fleece material having peripheral marginal edges configured to enable placement of said marginal edges in selective juxtaposed relation, and flatlock seams securing said juxtaposed marginal edges selectively together to define a foot receiving portion and a leg encompassing portion of the sock.

22. A method of making a sock having a foot receiving portion and a lower leg encompassing portion, said method comprising the steps of:

forming three blanks or patterns of *polyester* fleece material having generally rectangular plan configurations, a first one of said blanks having longitudinal marginal edges, a transverse end edge and a convexly curved opposite end edge; a second one of said blanks having longitudinal marginal edges and convexly curved opposite end edges; and a third one of said blanks having longitudinal marginal edges, a transverse end edge and a convexly curved opposite end edge, said longitudinal marginal edges and convexly curved edges enabling placement in selective juxtaposed relation;

positioning said blanks so that said marginal edges are disposed in said selective juxtaposed relation; and selectively securing said juxtaposed marginal edges together by flatlock seams so as to establish said foot receiving and leg encompassing sock portions.

* * * * *